United States Patent [19]

Langley

[11] 4,186,066

[45] Jan. 29, 1980

[54] ELECTROLYSIS CATHODES WITH AG-TI INTERMETALLIC COATING

[75] Inventor: Robert C. Langley, Fairfield, N.J.

[73] Assignee: Titanium Industries, Fairfield, N.J.

[21] Appl. No.: 953,741

[22] Filed: Oct. 26, 1978

[51] Int. Cl.[2] ..... C25B 1/16; C25B 1/26; C25B 11/10; C25B 11/04

[52] U.S. Cl. ..... 204/98; 204/128; 204/290 F; 204/291

[58] Field of Search ..... 204/290 F, 98, 291, 204/128; 427/229

[56] References Cited

U.S. PATENT DOCUMENTS

| | | | |
|---|---|---|---|
| 4,089,771 | 5/1978 | Westerlund | 204/290 F |
| 4,098,671 | 7/1978 | Westerlund | 204/290 F |

*Primary Examiner*—R. L. Andrews
*Attorney, Agent, or Firm*—Karl F. Ross

[57] ABSTRACT

A cathode for use in an electrolytic process which comprises a substrate metal with a surface coating of a silver-titanium intermetallic formed in situ on the cathode.

12 Claims, No Drawings

ELECTROLYSIS CATHODES WITH AG-TI INTERMETALLIC COATING

FIELD OF THE INVENTION

This invention relates to a new cathode for use in an electrolytic process as well as to a method for producing said cathode. More particularly, the invention relates to a titanium cathode suitable for the electrolytic production of chlorine or sodium chlorate.

BACKGROUND OF THE INVENTION

Chlorine is produced commercially in electrolytic cells in which an aqueous solution of sodium chloride is reacted to yield chlorine gas at the anode.

Various cell designs are employed and one in general use in the United States is the diaphragm cell. In this cell, the anode is titanium with a surface coating of an electrocatalytic material such as ruthenium dioxide or a platinum-iridium alloy. The cathode is mild steel in the form of a perforated sheet or a wire screen. Anolyte or catholyte zones of the cell are separated by a diaphragm and this is usually made of asbestos which is applied as a slurry to the cathode before the cell is assembled.

In a diaphragm cell, saturated brine is fed continuously to the anolyte compartment and the resistance to flow due to the membrane creates a hydrostatic head in the anolyte. A direct current is passed through the cell and chlorine is formed at the anode while sodium hydroxide and hydrogen are formed at the cathode. Product chlorine fills the head space of the enclosed cell and is removed by piping to a header. Hydrogen can not be permitted in the head space and is removed through the perforations or other openings in the cathode along with the spent brine.

Sodium chlorate is produced in a somewhat similar manner. In a sodium chlorate cell, the anode is titanium with the same electrocatalytic coating used for chlorine generation. The anode is usually a flat sheet of titanium and the cathode is usually a flat sheet of mild steel or titanium. There is no diaphragm. Saturated brine is fed continuously to the cell and under the influence of a direct current, sodium chloride is formed in solution at the anode. Hydrogen is formed at the cathode according to the overall reaction $$NaCl + 3H_2O + 6 \text{ Faradays } NaClO_3 + 3H_2.$$

In design of sodium chlorate cells, it is common to use the electrodes in a vertical position and to place them in close parallel arrangement, typically 0.5 inches or less apart. Hydrogen gas is envolved in large amounts and as it rises to the head space of the cell, this gas serves to agitate the electrolyte and contributes to the efficiency of the reaction. Product sodium chlorate is removed in solution in the spent brine.

In chlorine or chlorate cells of the type described, mild steel cathodes have advantages of low cost and low overpotential for hydrogen formation. They have the disadvantage that in the absence of a potential, chemical corrosion by hot, saturated brine is rapid. In the large plants operated by the major producers (DOW, PPG, Hooker, Pennwalt) it is common to have a stand-by cathodic protection system with its own generator to supply a small potential whenever the main power is off for any reason.

In contrast to mild steel, titanium cathodes are not chemically attacked by hot, saturated brine. While the cost of titanium is substantially higher than that of mild steel, elimination of the need for a stand-by cathodic protection system makes titanium an attractive cathode material and titanium cathodes are used, principally in some sodium chlorate cell designs. Titanium has a disadvantage in that its hydrogen overpotential is higher than that of mild steel, by approximately 0.2 volts. Cells operate at voltages of 3.2 to 4.0 volts with 3.5 volts being typical. Amperage is held constant since this determines plant production. An increase of 0.2 in cell voltage means an increase in power consumption of about 6%. Since power consumption represents half or more of the selling price of chlorine or sodium chlorate, a 6% increase is substantial.

A second disadvantage of titanium cathodes is that titanium metal reacts with hydrogen to form titanium hydride. Over a period of time (12 to 18 months) the immersed portion of a titanium cathode becomes saturated with titanium hydride. The portion of the cathode above electrolyte level has little or no titanium hydride. This concentration variation causes internal stresses which are sufficient to warp the cathode to a degree that it can touch the anode causing arcing and destruction of both electrodes. Cells which use titanium cathodes are usually shut down periodically for cathode inspection and replacement when hydride formation has reached an advanced state.

Since reduction of hydrogen overpotential (overvoltage) is economically important, earlier workers have developed coatings for cathodes to achieve this. For example, U.S. Pat. No. 3,974,058 describes steel cathodes having an intermediate coating of cobalt and an overcoating of ruthenium. U.S. Pat. No. 4,000,048 describes titanium cathodes which are coated with palladium-silver or palladium-lead alloys to lower hydrogen overpotential and to reduce hydrogen embrittlement of the titanium substrate (column 2, lines 39–46).

A novel approch which does not necessarily involve a coating is described in U.S. Pat. No. 4,075,070. These workers have found that a titanium alloy containing a very small amount of rare earth (preferably Ti-0.02% Y) has a hydrogen overpotential lower than that of pure titanium or certain other alloys of titanium. In addition, these workers have found that the preferred alloy has slower uptake of hydrogen as measured by weight gain in laboratory tests.

OBJECTS OF THE INVENTION

It is an object of this invention to provide a titanium-containing cathode with low hydrogen potential.

It is a more specific object of the invention to provide a titanium-containing cathode suitable for the electrolytic production of chlorine or sodium chlorate.

Another object is to provide an improved cell for the production of chlorine or sodium chlorate.

Still another object is to provide an improved method of making a cathode for the purposes described.

Yet another object is to provide an improved method of producing chlorine and sodium chlorate.

SUMMARY OF THE INVENTION

This invention provides a cathode of pure titanium, or a titanium alloy with a surface coating which lowers hydrogen overpotential compared to the uncoated substrate. The invention includes a process for applying the coating which promotes reaction with the substrate (formation of an intermetallic compound) to render the coating resistant to corrosion by hot, saturated brine when no potential is applied. The coating of this invention also reduces formation of titanium hydride in the substrate, thus extending usable life.

Hydrogen overpotential of pure titanium is high and there are many materials which can be applied as coatings to titanium to lower overpotential. In considering metallic coatings, the choice is narrowed substantially when the coating metal must also resist chemical corrosion by hot brine in the absence of a potential. Metals of the platinum group (Pt, Pd, Rh, Ir, Ru and Os) are candidate materials because of the outstanding resistance to chemical corrosion shown by some of them. However, platinum group metals have high solubility for hydrogen and a coating having its property would be expected to increase the rate at which hydrogen is introduced into a titanium substrate.

It is known that particular alloys of platinum group metals have little or even zero solubility for hydrogen. For example, pure palladium, when exposed to hydrogen gas (no electrical potential) at room temperature, becomes saturated with hydrogen instantaneously to form an equilibrium composition of PdH-0.6. Palladium alloys of gold, silver or copper have low solubility for hydrogen when the additive metal is present at a level of 25% or more by weight.

There are three metals in which hydrogen is not soluble. These are gold, silver and copper. However, all three dissolve in hot acidic brine with the rate of dissolution fastest for copper and slowest for gold. Gold is a very expensive metal and a cathode coating metal which is substantially cheaper is preferred.

As can be seen from the examples which follow, this invention describes a cathode coating which is initially silver and which is processed under conditions selected to promote substantial or complete formation of Ag-Ti intermetallic compounds. These compounds have excellent corrosion resistance to hot, saturated brine. They also have hydrogen overvoltage lower by approximately 0.1 volt than uncoated titanium. These desirable properties are obtained in very thin coatings on the order of 2 to 4 microinches which contain a minimum amount of silver. Coatings thinner than 2 microinches, for example even less than 1 microinch, can be used in applications where a cell is operated only for short intervals. On the other hand, substantially thicker coatings, having thicknesses of 50 microinches or more, may be used in situations where it is desired to operate cells for very long periods of time without shutting down for cathode replacement as the coating very gradually wears. However, for most common situations, coating thicknesses of 2 to 4 microinches is preferred. These thin coatings can be applied in a single application step, making the application process relatively inexpensive.

These are various methods by which a thin film of silver can be applied to titanium. Among them are electroplating, chemical reduction (Brashear mirror process) and application by brushing of a solution of a silver salt which is subsequently reduced to metallic silver by thermal decomposition. Any known method for applying uniform, thin films of silver on titanium can be used to carry out the first step of this invention. It is preferable to use a thermal composition of a silver salt applied from solution. This application method fits in extremely well with the second step of the invention, heating on a time-temperature cycle to form Ag-Ti intermetallics.

The firing cycle to form the desired intermetallic compounds varies somewhat depending on the atmosphere employed. Vacuum, or an argon atmosphere can be used but an air atmosphere is preferred. In large continuous furnaces of the type needed to mass produce cathodes with coatings of this composition, firing in air has significant economic advantages. The limits of the firing cycle which follow are those used in an air atmosphere.

The solution used to apply the coating can be silver nitrate (or other inorganic salt) dissolved in water or alcohol. However, a solution of this type is corrosive and must be handled carefully. In addition, thermally decomposed volatile oxides of nitrogen can cause corrosion problems in the exhaust system of the furnace. The preferred solution is made by dissolving a silver carboxylate in a mixture of essential oils. This solution is not corrosive during the application step. During the firing step, essential oils are volatilized and exhausted from the furnace. Silver carboxylate decomposes to yield metallic silver and the organic moiety is thermally cracked to carbon dioxide and water. The particular silver carboxylate used in the "best-mode" practice of this invention is commercially available from Engelhard Minerals and Chemicals Corp. and is identified as their Silver Solution #9567. The solvent is a mixture of essential oils. Although it is not stated by the manufacturer, it is probable that the silver compound is a short chain neo acid since the solution contains 25% Ag by weight.

The silver compound of Solution #9567 decomposes at approximately 150° C. to give a pure silver film. This film has relatively high surface area because of its extreme thinness and at 150° C. and higher temperatures, the silver is converted substantially to silver oxide. When the temperature of 300° C. is reached, silver oxide decomposes giving off oxygen. By firing above 300° C., the silver coating is maintained in the metallic state (even in the air atmosphere) and it is in this form that the coating can react with titanium to form intermetallic compounds. The minimum firing temperature used in this process is, therefore, 300° C. When titanium is heated in air, heavy surface oxidation occurs at about 650° C. and if this temperature is maintained for a long time, surface oxide penetrates into the grain boundaries and mechanical properties of the metal suffer (it becomes brittle). The maximum firing temperature is 650° C. and this temperature should be maintained for no longer than 15 minutes, with 5 minutes preferred. The preferred temperature is 550° C. and it has been found that firing for 15 minutes at this temperature produces coatings which perform well. If lower temperatures are used, time at those temperatures must be increased. If the minimum of 300° C. were used, firing time would extend to many hours, presenting problems in mass production of cathodes.

Two intermetallics are known in the Ag-Ti system. These are AgTi and $AgTi_3$. On the firing cycle used in the practice of this invention, it is believed that both intermetallics form. The active cathode coating may be a mixture of two intermetallic compounds. It is not considered essential to a useful coating that all of the silver applied be converted to an intermetallic. However, metallic silver will dissolve in hot brine when the current is turned off so any excess silver (not converted in the firing cycle) is wasted.

The following Examples describe several preferred embodiments of the invention. However, it is understood that the invention is not limited to the specific embodiments.

EXAMPLE I

A silver solution was made, having the following composition:

| | |
|---|---|
| Silver Solution #9567 (25% Ag) | 2.0 grams |
| Rosin dissolved in essential oils (40% rosin) | 12.0 |
| Oil of lavender | 12.0 |
| Oil of rosemary | 24.0 |
| | 50.0 |

The silver content of the solution was chosen to give a very thin metallic film per application. The solvent formulation was selected to give desireable flow properties when applied by brushing:

Titanium sheets in the form of flat mesh 7"×12"×0.080" in thickness were cleaned by degreasing. Surface oxide was removed and the surface was roughened by sandblasting. The mesh was cleaned in a detergent solution, rinsed with water and dried in air.

The titanium mesh was coated by brush application of the silver solution. The coated sample was fired by placing it on titanium supports on a continuous stainless steel belt which was moving through a large, production furnace open to the air. The sample was cooled in air upon leaving the furnace. Belt speed and temperature controls were selected to subject the sample to 550° C. for 15 minutes. A single application gave a coating thickness of 2 to 3 microinches. A second application and the firing were made to give a total film thickness of 5 microinches.

Strips 1"×7" were cut from the coated mesh and were tested in a small laboratory sodium clorate cell. Conditions were:

| | |
|---|---|
| Temperature | 65° C. |
| Electrolyte, NaCl | 300 gpl |
| ph | 6.5 to 7.2 |
| Voltage 3.3 to 3.5 | |

The anode in the cell was titanium coated with ruthenium dioxide. Tests were conducted by measuring cell voltage using a silver coated cathode and replacing this with an uncoated titanium cathode of identical size and comparing the measurements. On average, the silver coated cathodes gave cell voltages of 0.10 to 0.12 volts lower than uncoated cathodes, for identical amperage. The maximum reduction of cell voltage observed was 0.15 volts.

After measuring coated samples, power was turned off and the samples were left in the electrolyte (300 gpl NaCl) at 65° C. for 48 hours. Cell voltages were then measured again and the initial values, in all cases lower than those obtained with uncoated titanium cathodes, were reproduced.

EXAMPLE II

A titanium alloy, having composition by weight of Ti-Al-V 90-6-4, was cut into strips 8"×2"×0.078" in thickness. The strips were punched with a pattern of 0.0625" diameter holes evenly spaced, to give an open area of approximately 35%. The perforated strips were cleaned as described in Example I. Half of the strips were coated with a single application of the silver solution of Example I. These were fired in air to a peak temperature of 500° C. and maintained at this temperature for 30 minutes.

Coated and uncoated strips were masked with plastic tape to leave an exposed area of one square inch. Asbestos paper was taped over exposed areas to simulate the asbestos diaphragm used in commercial chlorine cells. Anodes in the test cell were made of titanium mesh coated with an electrocatalytic alloy of Pd-IR 70-30 by weight. Saturated brine was preheated with caustic and soda ash to remove calcium and magnesium. After filtering, brine was heated to 55° C. and flowed through the test cell.

Coated samples were compared to uncoated samples by applying voltage until a current of 2.0 amps was indicated on an amp-meter. All coated samples achieved this current at a lower voltage than uncoated samples. On average, this was 0.1 volts lower.

I claim:

1. A cathode for use in an electrolytic cell comprising a metal substrate selected from the group consisting of titanium and titanium alloys with a surface coating consisting essentially of at least one silver-titanium intermetallic compound.

2. The cathode defined in claim 1 in which the metal substrate is titanium.

3. The cathode defined in claim 1 in which the surface coating is 2 to 4 microinches in thickness.

4. The cathode defined in claim 1 wherein said intermetallic compound is formed in situ on the substrate by reaction of silver with titanium.

5. In an electrolysis cell for the production of chlorine or sodium chlorate by electrolysis using a titanium cathode, the improvement wherein said cathode is constituted as defined in claim 1.

6. A process for producing a cathode for use in an electrolytic cell comprising a metal substrate selected from the group consisting of titanium and titanium alloys with a surface coating consisting essentially of a silver-titanium intermetallic which comprises the steps of:

(a) applying a thin film consisting essentially of metallic silver to the metal substrate; and (b) heating the metal substrate at a temperture and under an atmosphere to provide formation of at least one silver-titanium intermetallic compound.

7. The process in claim 6 wherein the thin film of metallic silver is 2 to 4 microinches as applied during step (a).

8. The process defined in claim 6 wherein heating step (b) is carried out at a temperature of about 300° C. to 650° C.

9. The process defined in claim 6 wherein heating step (b) is carried out at a temperature of about 550° C.

10. The process defined in claim 6 wherein heating step (b) is carried out in the air.

11. The process defined in claim 6 wherein heating step (b) is carried out for a period of about 15 minutes.

12. In the production of chlorine or sodium chlorate by electrolysis with a cathode, the improvement which comprises the step of using as the cathode a structure with an intermetallic coating surface produced by the method defined in claim 6.

* * * * *